United States Patent [19]

Köhnen et al.

[11] Patent Number: 4,807,698

[45] Date of Patent: Feb. 28, 1989

[54] HEAT EXCHANGER FOR GASES UNDER HIGH PRESSURE

[75] Inventors: Klaus Köhnen, Mülheim/Ruhr; Hans Niermann, Essen, both of Fed. Rep. of Germany

[73] Assignee: Krupp-Koppers GmbH, Essen, Fed. Rep. of Germany

[21] Appl. No.: 35,097

[22] Filed: Apr. 6, 1987

[30] Foreign Application Priority Data

May 10, 1986 [DE] Fed. Rep. of Germany ..... 3615877

[51] Int. Cl.[4] ..... F28F 9/22

[52] U.S. Cl. ..... 165/145; 165/74; 122/6 A

[58] Field of Search ..... 165/74, 75, 145; 122/510, 512, 32, DIG. 11, 390, 392, 6 A

[56] References Cited

U.S. PATENT DOCUMENTS

| | | | |
|---|---|---|---|
| 2,057,437 | 10/1936 | Leach | 165/145 X |
| 2,071,277 | 2/1937 | Barclay et al. | 165/145 X |
| 2,199,216 | 4/1940 | Conti | 165/145 |
| 3,814,062 | 6/1974 | Vollhardt | 122/6 A |
| 3,958,629 | 5/1979 | Andersson | 122/510 |
| 4,479,536 | 10/1984 | Lameric | 122/6 A X |
| 4,638,857 | 1/1987 | Fournier | 122/510 X |

FOREIGN PATENT DOCUMENTS

| | | | |
|---|---|---|---|
| 2933716 | 6/1985 | Fed. Rep. of Germany | 165/145 |

*Primary Examiner*—Michael Koczo
*Assistant Examiner*—Peggy Neils
*Attorney, Agent, or Firm*—Michael J. Striker

[57] ABSTRACT

A heat exchanger for gases under high pressure comprises a pressure vessel, a pluraity of heat exchanger trains arranged in the pressure vessel so that gas flows through the heat exchanger trains, the heat exchanger trains being formed as substantially identical structural units, the heat exchanger trains being connected with one another with a gas deflection therebetween and being connected with the pressure vessel so that they are releasable from and separately removable from the pressure vessel, elements for gas deflection between the heat exchanger trains, and elements for releasably and separately connecting the heat exchange trains to the pressure vessel.

14 Claims, 5 Drawing Sheets

2
4
12
53
52
54
50
3
55
55
10
13
8
10
7
6
6
5
9
II
I
1
5
11
11
22
22
16
17
15
21
14
18
20
18
19

HEAT EXCHANGER FOR GASES UNDER HIGH PRESSURE

BACKGROUND OF THE INVENTION

The present invention relates to a heat exchanger for gases under high pressure, particularly gases produced during gasification of fuels, in which gas flows through heat exchanger trains arranged in a pressure vessel.

Heat exchangers of the above mentioned general type are known in the art. One of such heat exchangers is disclosed, for example, in the German Pat. No. 2,933,716. In this patent, the heat exchanger trains are formed from multi-pipe walls which are arranged concentrically to one another and connected with a gasification device. The heat exchanger trains and the gasification device are arranged in a common pressure vessel. The disadvantage of this known arrangement is that in the event of damages of the heat exchanger trains, they are accessible with difficulties and their repair can be performed only inside the pressure vessel. In addition to the difficulties experienced by personnel for performing repair works, long interruptions in the operation of the whole installation take place.

SUMMARY OF THE INVENTION

Accordingly, it is an object of the present invention to provide a heat exchanger of the above mentioned type, which avoids the disadvantages of the prior art.

More particularly, it is an object of the present invention to provide a heat exchanger of the above mentioned general type in which in the event of damages, a fast and simple repair is possible, and moreover a maximum number of heat exchanger surfaces is provided in a narrow space.

In keeping with these objects and with others which will become apparent hereinafter, one feature of the present invention resides in that heat exchanger trains are formed as substantially identical structural units, the heat exchanger trains are loaded with gas in an ascending and descending manner or vise versa, they are connected with one another by gas deviating elements, and also each heat exchanger is connected with the pressure vessel in removable and separately withdrawable manner.

In the inventive heat exchanger, two or more heat exchanger trains can be provided. They are arranged very close relative to one another in a space-economical manner. When damages occur to only one heat exchanger train, it can be separated from other heat exchanger trains connected therewith and, after releasing from the pressure vessel, can be removed independently from the other heat exchanger trains. After this, an intact heat exchanger train can be inserted into the pressure vessel and mounted in its operative position. The required interruptions in the operation for this exchange of the heat exchanger train take only a very short time.

For a simple exchange of the heat exchanger trains, it is also proposed in accordance with the present invention to form an upper part of the pressure vessel removable from its lower part with the use of a flange connection between these parts. In accordance with still a further advantageous feature of the present invention, the heat exchanger trains are suspended in the pressure vessel and can expand downwardly, for example a fixed bearing is provided in the upper part of the pressure vessel.

Still a further feature of the present invention is that two neighboring heat exchanger trains are connected with one another by a gas-deviating structure which is formed as a releasable hood composed of a plurality of pipes.

Another advantageous feature of the present invention is that a gas supply and discharge which extends through the pressure vessel includes separate gas supply and discharge elements for each of the heat exchanger trains, formed as multi-pipe structures. They are connected with the heat exchanger trains by sealing means which allow their relative movement.

A further feature of the present invention is that in the region of the lower connection between the heat exchanger trains, which the first heat exchanger is loaded by gas in a descending manner and the second heat exchanger is loaded by gas in ascending manner, an outlet extending from the pressure vessel is provided for dust which is separated during deflection of the gas.

Finally, a dust separator arranged outside of the pressure vessel can be provided between two heat exchanger trains loaded with gas in ascending and descending manner or vice versa.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
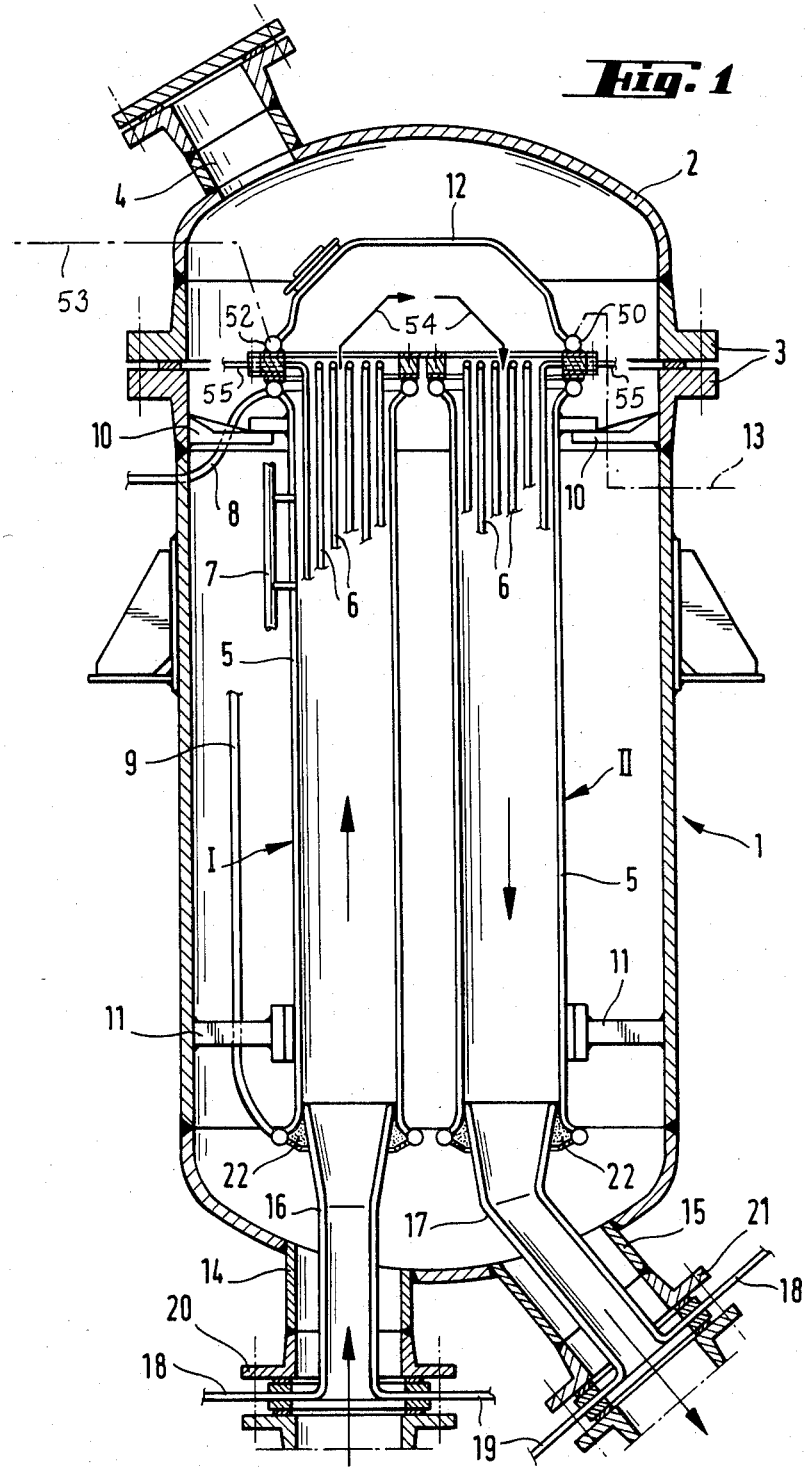
FIG. 1 is a vertical section of a heat exchanger in accordance with the present invention.

FIG. 1 shows a pressure vessel which is identified with reference numeral 1. Its upper part 2 is releasably and removably connected by means of a flange structure 3. A manhole in the upper part of the pressure vessel is identified with reference numeral 4.

Two heat exchanger trains I and II are arranged in this embodiment inside the pressure vessel I. They are formed as substantially identical structural units. Each heat exchanger train has a multi-pipe wall 5 which in the shown example has a square shape, and a bundle of pipes 6 inside the wall 5. A soot blowing system is identified with reference numeral 7, and descending and ascending conduits are identified with reference numerals 8 and 9 respectively.

The heat exchanger trains I and II are suspended on fixed supports 10 in the pressure vessel 1 and can expand downwardly where guiding supports 11 are provided.

A hood 12 is connected with the train at the upper end of both heat exchanger trains and also formed as a pipe structure with a water supply conduit 13.

The heat exchanger train I is loaded with hot gases in an ascending manner, while the heat exchanger train II is loaded with hot gases in a descending manner. The hood 12 serves for a deflection of the gas stream. Pipes 14 and 15 are arranged on the lower end of the pressure vessel 1. These pipes surround pipe structures 16 and 17 with supplying and withdrawing conduits 18 and 19 in the region of the flange connection 20 and 21. The pipe structures 16 and 17 through which the gases flow, are inserted into the multi-pipe walls 5 of both heat exchanger trains so that a relative movement resulting from the thermal expansion is possible. Loose-fill packings 22 serve for effective sealing at the connecting point.

The supply conduit 13 for the hold opens into a distributing pipe 50. A plurality of individual pipes 31 extend from the supply pipe 50 and narrowly lie against one another to be welded with one another. From the pipes 51 water flows to a collecting pipe 52 and then flows out through a conduit 53. The hood 12 which is composed of the individual pipes 51 forms a closed water system which has no connection with the multi-pipe wall 5 and the bundles of pipes 6. Hot gases flow through the interior of the hood 12 as identified with the arrows 54. These gases are supplied through the pipe structure 16 which forms an inlet, into the interior of the multi-pipe wall 5 of the heat exchanger unit I wherein they flow around the water-containing pipes of the pipe bundle 6, then they flow through the hood 12 into the interior of the multi-pipe wall 5 of the heat exchanger unit II which also has the bundle of pipes 6, and then are discharged through the pipe structure 17 which forms an outlet.

The inlet structures 16 and 17 each include a plurality of individual pipes which lie over one another and are welded with one another. The water supply to these individual pipes is identified at 18 while the water discharge from these individual pipes is identified with reference numeral 19.

Water is supplied through supply conduit 55 to the pipes of the pipe bundle 6 and flows through these pipes. The water discharge is not shown since it is located at the same height as the conduit 15 behind it. Each bundle of pipes 6 is a closed water system without connection to another water system, such as the hood 12, the multi-pipe wall 5, and the pipe structures 16 and 17.

The space between the wall 1 of the pressure vessel and inserts or the multi-pipe structures 5, 12, 16, 17 is an empty space through which no medium passes. This space can be filled with a product gas so as to provide in it the same pressure as in the interior of the multi-pipe structures so that the latter is not loaded with any pressure.

When because of a defect one heat exchanger train has to be withdrawn from the pressure vessel 1, the upper part of the pressure vessel 2 is first removed after releasing the flange connection 3. The hood 12 is then released from the respective heat exchanger train and removed upwardly from the pressure vessel. After releasing the defective heat exchanger train from the fixed bearing 10 and after separation of the descending and ascending conduits 8 and 9 as well as the supply to the soot blowing system 7, the heat exchanger train can be withdrawn upwardly from the pressure vessel. Finally, an intact heat exchanger train can be inserted into the pressure vessel, and the above described operational steps are performed in respective sequence.

In the event if the pipe bundle 6 of one heat exchanger train has a defect, then after removal of the upper part 2 of the pressure vessel and the hood 12, the pipe bundle can be withdrawn directly from the square multi-pipe wall 5. The multi-pipe wall 5 remains, in this case, in its position in the pressure vessel 1.

Figure 2:
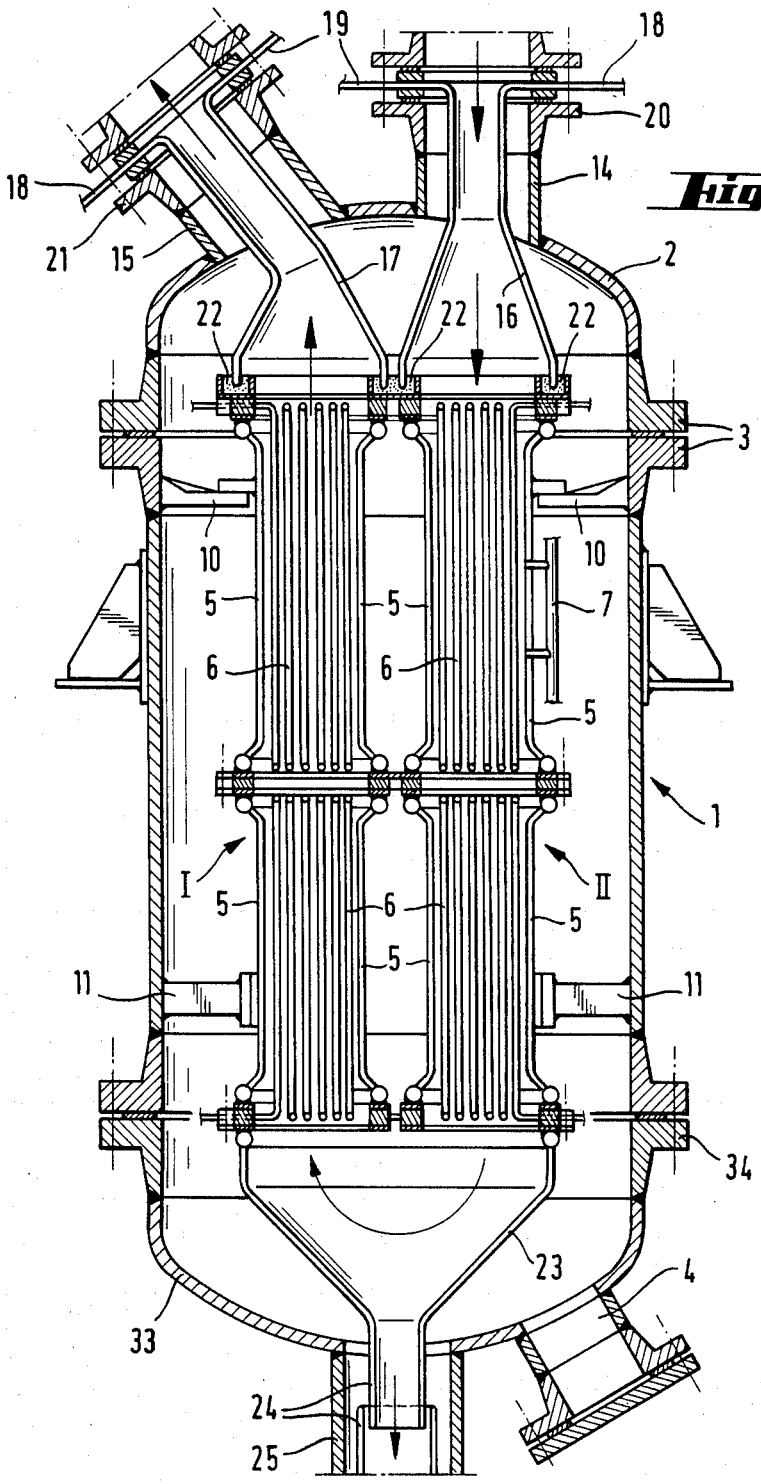
FIG. 2 is a view showing a vertical section of the inventive heat exchanger in accordance with another embodiment of the invention.

The heat exchanger in accordance with the embodiment shown in FIG. 2 has the same arrangement of the heat exchanger trains I and II in the pressure vessel 1 as in FIG. 1. However, it differs from the embodiment of FIG. 1 in the gas supply. Here the pipes 14 and 15 for the gas supply and withdrawal are arranged in the upper part 2 of the pressure vessel 1. Therefore, the heat exchanger train 2 is first loaded in the descending manner and after the deviation of the gas at the lower end, then the heat exchanger train 1 is loaded in ascending manner. On the lower end of the heat exchanger trains, a funnel 23 formed as a pipe structure is provided. It has an increased flow cross section and serves for catching of dust which separates from the gas stream during the deflection and speed reduction of the gas. An outlet 24 of the funnel, which is subdivided for compensation of thermal expansion, extends through a pipe 25 downwardly. A lower part 33 of the pressure vessel 1 is mounted removably by means of a flange connection 34, for the purpose of dismounting of the funnel 23.

Figure 3:
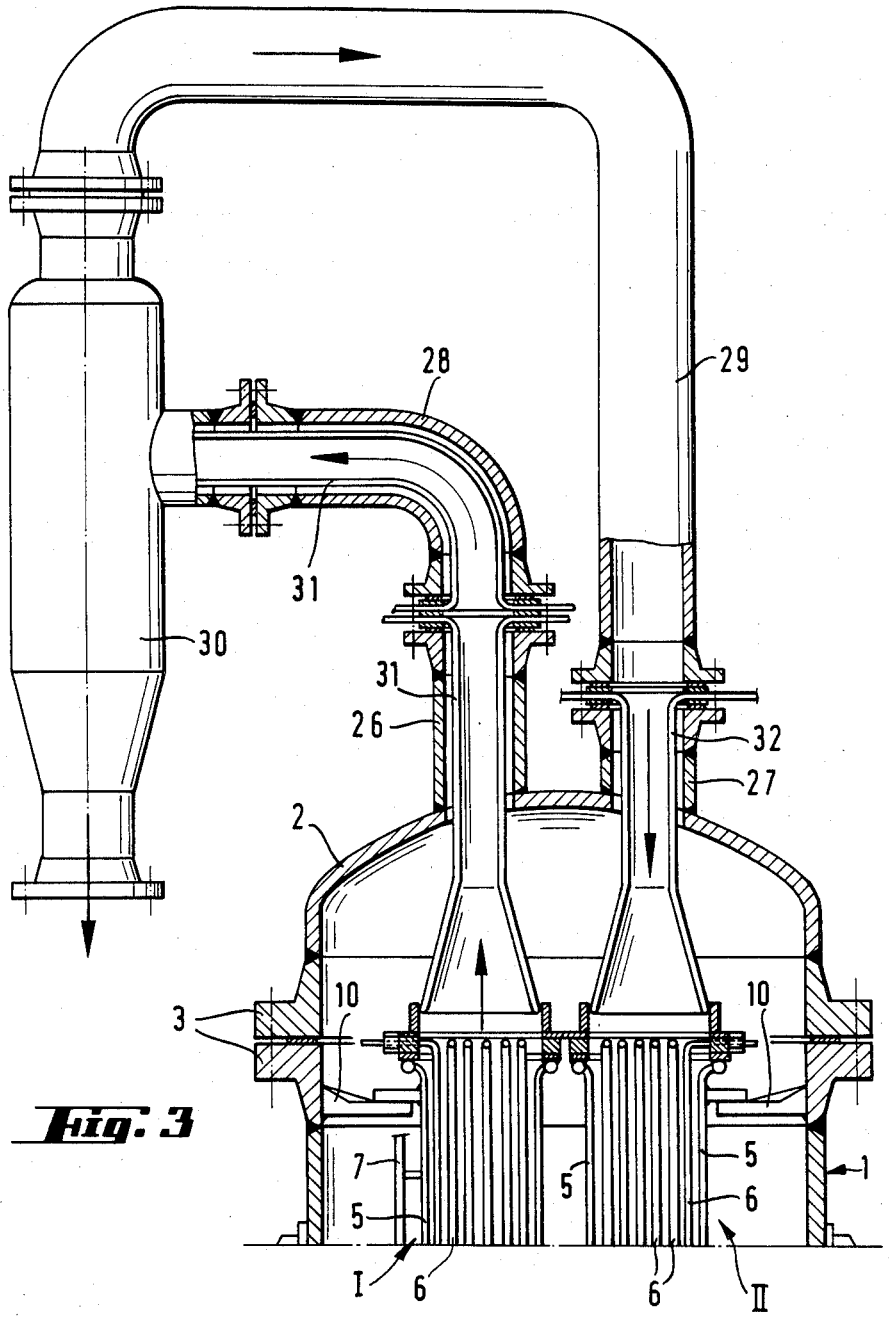
FIG. 3 is a view showing a vertical section of the inventive heat exchanger in accordance with still a further embodiment of the invention.

The heat exchanger shown in FIG. 3 has substantially the same construction as the heat exchanger of FIG. 1. However, an additional gas inlet and outlet is provided in the upper part 2 of the pressure vessel 1. Pipes 26 and 27 are provided for this purpose. Supply and withdrawal conduits 28 and 29 arranged on the pipes 25 and 27 extend to and from a dust separator 30 which is located outside of the pressure vessel. The gas supply in the conduits 28 and 29 are performed by inserted pipe structures 31 and 32. The interposition of the dirt separator 30 which can be formed as a cyclone head has the advantage that the flying dust no more is guided through the heat exchanger train II. Moreover, the flying dust is under a relatively high temperature level, which during return of the flying dust is into the reaction chamber of a gasification device connected with the heat exchanger acts in an advantageous manner.

Figure 4:
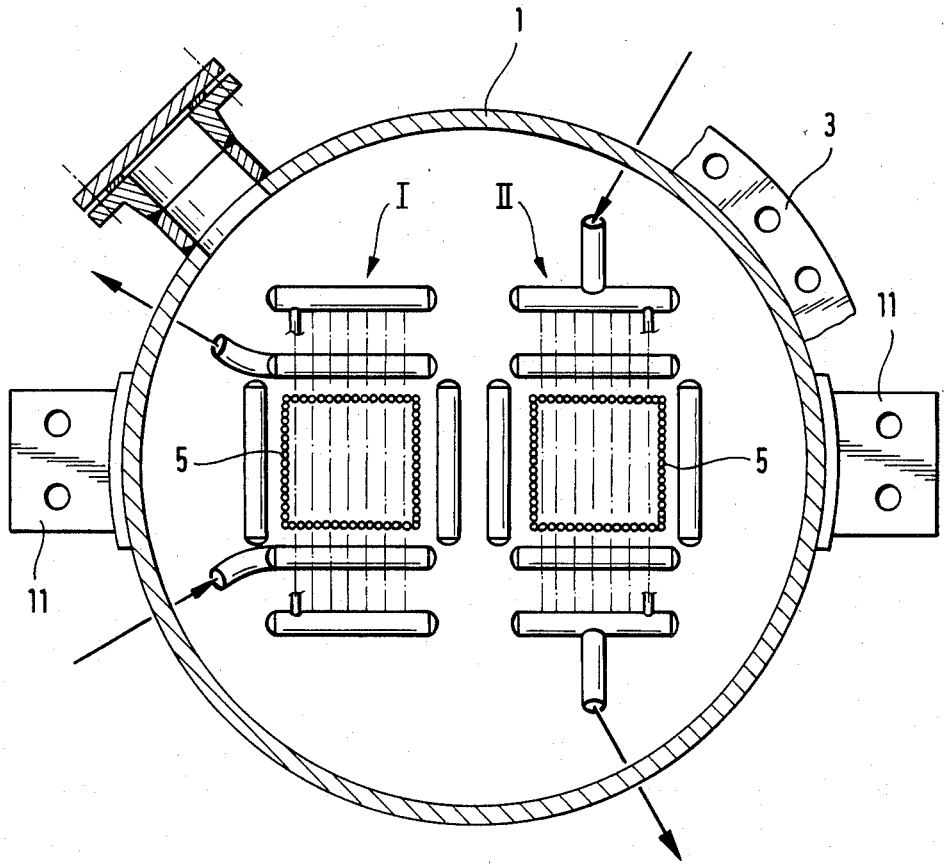
FIG. 4 is a view showing a horizatonal section of the heat exchangers shown in FIGS. 1–3.

FIG. 4 shows a horizontal section through the heat exchanger in accordance with the embodiment of FIGS. 1–3, wherein the heat exchanger trains I and II are arranged in the pressure vessel 1.

In the arrangement shown in FIG. 1, four heat exchanger trains I, II, III and IV are arranged in the pressure vessel 1. It is possible here to form the heat exchanger so that the gas stream passes the heat exchanger trains one after the other. It is also possible to form the heat exchanger so that two pairs of heat exchange trains are formed, namely one pair including the heat exchangers I and II, and the pair including the heat exchangers III and IV. The pairs of heat exchangers are loaded with separate gas streams independently from one another.

Figure 5:
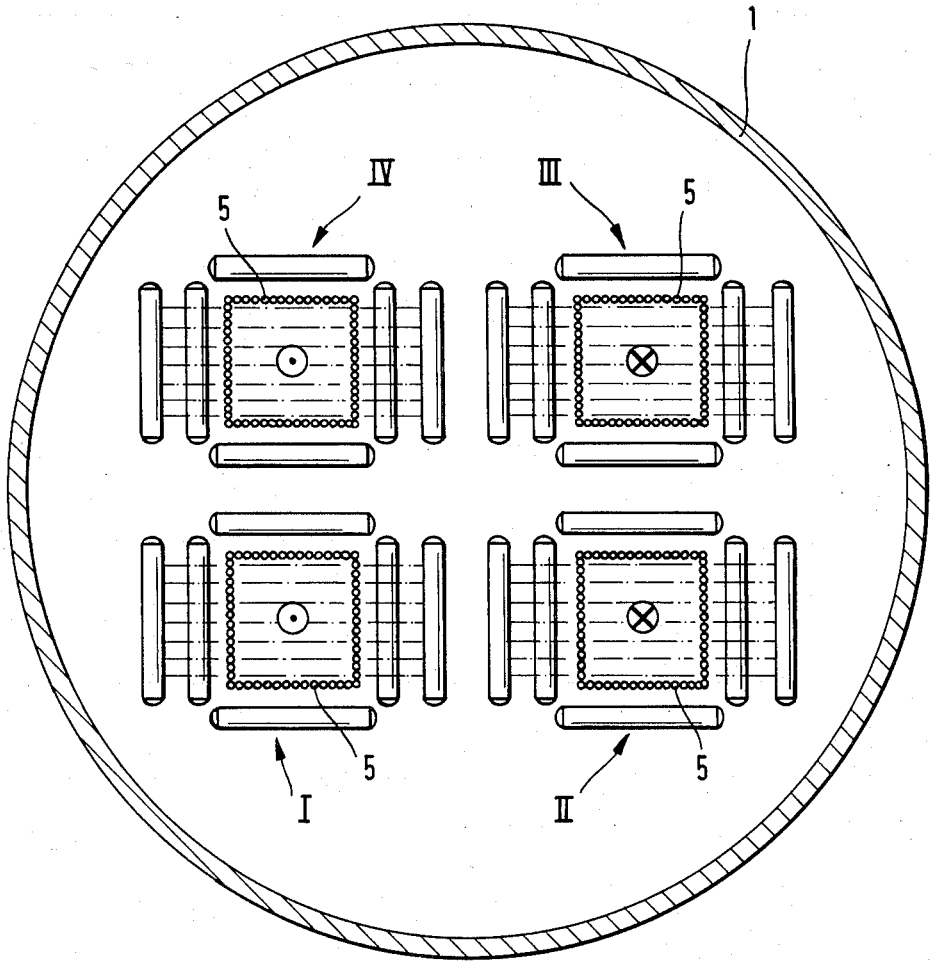
FIG. 5 is a view showing a horizontal section of the inventive heat exchanger in accordance with an additional embodiment of the present invention.

FIG. 5 shows especially clearly that the heat exchanger in accordance with the present invention is space-economical and utilizes the interior of the pressure vessel in an advantageous manner.

It will be understood that each of the elements described above, or two or more together, may also find a useful application in other types of constructions differing from the types described above.

While the invention has been illustrated and described as embodied in a heat exchanger, it is not intended to be limited to the details shown, since various modifications and structural changes may be made without departing in any way from the spirit of the present invention.

Without further analysis, the foregoing will so fully reveal the gist of the present invention that other can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A heat exchanger for gases under high pressure, comprising a pressure vessel; a plurality of heat exchanger trains arranged in said pressure vessel so that gas flows through said heat exchanger trains one after the other, said heat exchanger trains being formed as substantially identical structural units each including a multi-pipe outer limiting wall and a bundle of pipes located inside said wall, said heat exchanger trains being connected with one another with a gas deflection therebetween and being connected with said pressure vessel so that they are releasable from and separately removable from said pressure vessel; means for supplying water into and withdrawing the water from each of said multi-pipe outer limiting walls; means for supplying water into and withdrawing water from each of said bundles of pipes; means for supplying gas into a space inside each of said multi-pipe walls and around each of said bundles of pipes, and withdrawing the gas from the space; means for gas deflection between said heat exchanger trains; and means for releasably and separately connecting said heat exchanger trains to said pressure vessel.

2. A heat exchanger as defined in claim 1, wherein said pressure vessel has a lower part and an upper part, said upper part being removably connected with said lower part; and further comprising flange connecting means for removably connecting said upper part to said lower part of said pressure vessel.

3. A heat exchanger as defined in claim 1, wherein said means for connecting said heat exchanger trains is formed so that said heat exchanger trains are suspended in said pressure vessel and can expand downwardly.

4. A heat exchanger as defined in claim 1, wherein said gas deflecting means includes a removable hood connecting respective ones of said heat exchanger trains with one another.

5. A heat exchanger as defined in claim 4, wherein said hood includes a plurality of pipes.

6. A heat exchanger as defined in claim 1, wherein said means for supplying gas into a space and withdrawing the gas from the space includes a separate gas supply element and a separate gas withdrawal element for each of said heat exchanger trains and each including a plurality of pipes.

7. A heat exchanger as defined in claim 6, wherein said gas supply elements and said gas withdrawal elements are connected with respective ones of said heat exchanger trains so that they are movable relative to one another.

8. A heat exchanger as defined in claim 7; and further comprising sealing means arranged between said gas supply and gas withdrawal elements and respective ones of said heat exchanger trains and formed so as to allow said relative movement of said gas supply and withdrawal elements relative to said heat exchanger trains.

9. A heat exchanger as defined in claim 1, wherein said heat exchanger trains include at least two heat exchanger trains of which one heat exchanger trains operates with gas descending and the other heat exchanger trains operates with gas ascending, said at least two heat exchanger trains having lower ends and being connected at said lower ends in a connecting point, said pressure vessel having an outlet in the region of the said connecting point and formed for dust separating during deflection of gas.

10. A heat exchanger as defined in claim 9, wherein said gas deflecting means includes a funnel which connects said at least two heat exchanger trains with one another in said connecting point, said pressure vessel having an upper part and a lower part, said lower part being removably connected with said upper part so as to allow upon its removal a dismounting of said funnel.

11. A heat exchanger as defined in claim 10; and further comprising means for removably connecting said lower part with said upper part of said pressure vessel and including a flange connection.

12. A heat exchanger as defined in claim 1; and further comprising a dust separator arranged between at least two of said exchanger trains.

13. A heat exchanger as defined in claim 12, wherein said dust separator is located outside of the said pressure vessel.

14. A heat exchanger as defined in claim 1, wherein said pipe bundle is removable from said pressure vessel so as to retain said multi-pipe wall inside said pressure vessel.

* * * * *